US008740993B2

(12) United States Patent
Christensen et al.

(10) Patent No.: US 8,740,993 B2
(45) **Date of Patent: *Jun. 3, 2014**

(54) METHOD FOR REDUCED ENCRUSTATION OF TEXTILES USING A POLYMER COMPRISING MALEIC ACID, VINYL ACETATE, AND ALKYL ACRYLATE

(75) Inventors: Stephen Christensen, Inver Grove Heights, MN (US); Lauren M. Hunker, Minneapolis, MN (US); Carter Silvernail, Burnsville, MN (US); Brandon G. Beyer, Mendota Heights, MN (US); Kerrie E. Walters, St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/428,632

(22) Filed: Mar. 23, 2012

(65) Prior Publication Data

US 2013/0252873 A1 Sep. 26, 2013

(51) Int. Cl.
*B08B 3/04* (2006.01)
*C11D 1/66* (2006.01)

(52) U.S. Cl.
USPC ..... 8/137; 510/339; 510/356; 510/361; 510/434; 510/475; 510/476; 510/477; 510/478

(58) Field of Classification Search
USPC ..... 510/339, 356, 361, 434, 475, 476, 477, 510/478; 8/137
See application file for complete search history.

(56) References Cited

U.S. PATENT DOCUMENTS

| | | | |
|---|---|---|---|
| 3,048,548 | A | 8/1962 | Martin et al. |
| 3,321,408 | A | 5/1967 | Briggs |
| 3,334,147 | A | 8/1967 | Brunelle et al. |
| 3,422,021 | A | 1/1969 | Roy |
| 4,618,914 | A | 10/1986 | Sato et al. |
| 4,782,901 | A | 11/1988 | Phelps et al. |
| 4,830,773 | A | 5/1989 | Olson |
| 4,834,955 | A | 5/1989 | Mouche et al. |
| 5,191,048 | A | 3/1993 | Swift et al. |
| 5,290,468 | A | 3/1994 | Turcotte et al. |
| 5,346,974 | A | 9/1994 | Iovine et al. |
| 5,574,113 | A | 11/1996 | Kroner et al. |
| 5,574,120 | A | 11/1996 | Heidel et al. |
| 5,576,407 | A | 11/1996 | Kroner et al. |
| 5,876,514 | A | 3/1999 | Rolando et al. |
| 5,900,229 | A | 5/1999 | Dupuis |
| 5,929,014 | A | 7/1999 | Beaujean et al. |
| 6,200,498 | B1 | 3/2001 | Gonzalez et al. |
| 6,340,664 | B1 | 1/2002 | Gassenmeier et al. |
| 6,383,993 | B1 | 5/2002 | Maurin et al. |
| 6,383,994 | B1 | 5/2002 | Maurin et al. |
| 6,383,995 | B1 | 5/2002 | Beauquey et al. |
| 6,383,996 | B1 | 5/2002 | Maurin et al. |
| 6,387,864 | B1 | 5/2002 | Bartelme |
| 6,403,524 | B2 | 6/2002 | Scott et al. |
| 6,432,894 | B1 | 8/2002 | Maurin et al. |
| 6,534,455 | B1 | 3/2003 | Maurin et al. |
| 6,562,772 | B1 | 5/2003 | Maurin et al. |
| 6,812,194 | B2 | 11/2004 | Ruhr et al. |
| 6,820,626 | B1 | 11/2004 | Jonke et al. |
| 7,375,070 | B2 | 5/2008 | Pegelow et al. |
| 7,524,803 | B2 | 4/2009 | Lentsch et al. |
| 7,638,473 | B2 | 12/2009 | Smith et al. |
| 2003/0056301 | A1 | 3/2003 | Dekker et al. |
| 2003/0158078 | A1 | 8/2003 | Chang |
| 2004/0053808 | A1 | 3/2004 | Raehse et al. |
| 2004/0106534 | A1 | 6/2004 | Nitsch et al. |
| 2004/0152616 | A1 | 8/2004 | Murphy et al. |
| 2005/0205574 | A1 | 9/2005 | Lambotte et al. |
| 2005/0225003 | A1 | 10/2005 | Holderbaum et al. |
| 2006/0035804 | A1 | 2/2006 | Penninger et al. |
| 2009/0010855 | A1 | 1/2009 | Lepilleur et al. |
| 2009/0069202 | A1 | 3/2009 | Strapp et al. |
| 2009/0105114 | A1 | 4/2009 | Stolte et al. |
| 2009/0305934 | A1 | 12/2009 | Creamer et al. |
| 2010/0189664 | A1 | 7/2010 | Castro et al. |
| 2011/0124546 | A1* | 5/2011 | Tjelta et al. ..... 510/445 |

FOREIGN PATENT DOCUMENTS

| | | | |
|---|---|---|---|
| EP | 0451434 | B1 | 10/1991 |
| EP | 0510944 | B1 | 10/1992 |
| EP | 0524546 | A2 | 1/1993 |
| EP | 0760846 | B1 | 3/1997 |
| EP | 0798320 | A2 | 10/1997 |
| EP | 0835925 | A2 | 4/1998 |
| EP | 0881281 | A2 | 12/1998 |
| EP | 0884298 | A2 | 12/1998 |
| EP | 1093787 | B1 | 4/2001 |
| EP | 1735418 | B1 | 12/2006 |
| WO | WO9530732 | A1 | 11/1995 |
| WO | WO9811187 | A1 | 3/1998 |
| WO | WO0070006 | A1 | 11/2000 |
| WO | WO2008079855 | A2 | 7/2008 |

OTHER PUBLICATIONS

Florjanczyk, Zbigniew et al., "Terpolymerization of maleic anhydride with vinyl monomers", Journal of Polymer Science, part A: Polymer Chemistry, Nov. 1989, vol. 27, No. 12, pp. 4099-4108.

Hiraguri, Yoichi et al., "Syntheses of biodegradable functional polymers by radical ring-opening polymerization of 2-methylene-1,3,6-trioxocane", Journal of Polymers and the Environment, 2010, v. 18, No. 2, pp. 116-121.

Li, Xiaofang et al., "Photocopolymerization of maleic anhydride and vinyl acetate", Chinese Journal of Polymer Science (English Edition), 1990, vol. 8, No. 3, pp. 261-268.

* cited by examiner

*Primary Examiner* — Brian P Mruk
(74) *Attorney, Agent, or Firm* — Amy J. Hoffman

(57) ABSTRACT

A laundry detergent composition includes an alkalinity source, at least one nonionic surfactant and a polymer comprising maleic acid, vinyl acetate and alkyl acrylate monomers. The alkalinity source is present in an amount between about 1% and about 75% by weight of the laundry detergent composition and includes at least one member selected from alkali metal hydroxides, carbonates, and bicarbonates. The polymer comprising maleic acid, vinyl acetate and alkyl acrylate monomers is present in an amount equal to or greater than about 0.5% by weight of the laundry detergent composition.

9 Claims, No Drawings

METHOD FOR REDUCED ENCRUSTATION OF TEXTILES USING A POLYMER COMPRISING MALEIC ACID, VINYL ACETATE, AND ALKYL ACRYLATE

CROSS REFERENCE TO RELATED APPLICATIONS

This application is related to U.S. Pat. No. 8,623,151 entitled "TERPOLYMER CONTAINING MALEIC ACID, VINYL ACETATE, AND ALKYL ACRYLATE MONOMERS FOR ALUMINUM PROTECTION," U.S. application Ser. No. 13/428,643 entitled "A CLEANING COMPOSITION INCLUDING A TERPOLYMER CONTAINING MALEIC ACID, VINYL ACETATE, AND ALKYL ACRYLATE MONOMERS FOR ENHANCED SCALE CONTROL," now abandoned and to U.S. application Ser. No. 13/428,637 entitled "A CLEANING COMPOSITION INCLUDING A TERPOLYMER CONTAINING MALEIC ACID, VINYL ACETATE, AND ALKYL ACRYLATE MONOMERS FOR ENHANCED SCALE CONTROL," now abandoned, which were filed concurrently herewith. The entire contents of these patent applications are hereby expressly incorporated herein by reference including without limitation, the specification, claims, and abstract, as well as any figures, tables or drawings thereof.

TECHNICAL FIELD

The results invention relates to a laundry detergent composition having reduced encrustation, and to a method of using the same. The detergent composition comprises a polymer comprising maleic acid, vinyl acetate and alkyl acrylate monomers.

BACKGROUND

Alkalinity sources are used in laundry detergent compositions for a variety of reasons, one of which is to provide detersive action and improved soil removal performance. Typical sources of alkalinity include alkali metal hydroxides such as potassium hydroxide and sodium hydroxide, and alkaline earth metal silicates including potassium silicate and sodium silicate.

The performance of any detergent is affected by the hardness of the wash water, with higher levels of hardness, or calcium ion content, typically reducing the detergency or soil removal performance of the detergent. Alkaline detergents, particularly those intended for institutional and commercial use, generally contain phosphates, nitrilotriacetic acid (NTA) and ethylenediaminetriacetic acid (EDTA) to remove soils and to sequester metal ions such as calcium, magnesium, and iron.

In particular, phosphates, NTA or EDTA are used in detergents because of their ability to solubilize pre-existing inorganic salts and/or soils. When calcium, magnesium and iron salts precipitate, the crystals may attached to the surface being cleaned and cause undesirable effects. In the laundering area, if calcium carbonate precipitates and attaches onto the surface of fabric, the crystals may leave the fabric feeling hard and rough to the touch. In addition to encrustation, high levels of water hardness also contribute to graying of the fabric.

SUMMARY

The present invention includes a laundry detergent composition having reduced encrustation. The detergent composition includes an alkalinity source, a nonionic surfactant, and a polymer comprising maleic acid, vinyl acetate and alkyl acrylate monomers. The alkalinity source includes an alkali metal hydroxide, an alkali metal carbonate, an alkali metal bicarbonate or a mixture thereof.

In one embodiment, the present invention is a laundry detergent composition including the alkalinity source in an amount between about 1% and about 75% by weight, at least one nonionic surfactant in an amount between about 0.5% and about 50% by weight, and the polymer containing maleic acid, vinyl acetate and alkyl acrylate monomers in an amount between about 0.5% and about 20% by weight. The polymer comprises, consists of, or consists essentially 30%-99% monomer of maleic acid by weight, 1%-60% monomer of vinyl acetate by weight, and 1%-60% alkyl acrylate monomer by weight. The laundry detergent can optionally include at least one polymer comprising acrylate monomers in an amount between about 0.5% and about 30% by weight.

In another embodiment, the detergent is used in a method of cleaning textiles with reduced encrustation. The detergent is mixed with water to form a use composition. The detergent comprises an alkalinity source, at least one nonionic surfactant and a polymer composed of maleic acid, vinyl acetate and alkyl acrylate monomers. The use composition has a polymer concentration of approximately 20 to approximately 1,000 parts per million, a pH between about 10 and about 14, and temperature between about 104 and 110 degrees Fahrenheit. In a still further embodiment, the detergent can further include a second polymer containing acrylate monomers.

In still another embodiment, a detergent composition consists essentially of 1%-75% sodium hydroxide by weight, 0.5%-20% by weight of a polymer comprising maleic acid, vinyl acetate and alkyl acrylate monomers, at least one functional ingredient, such as at least one nonionic surfactant, and optionally 0.5%-30% by weight of at least one polymer comprising acrylate monomers.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

The laundry detergent compositions of the present invention provide a high alkalinity detergent which comprises, consists of or consists essentially of an alkalinity source, at least functional ingredient, such as a nonionic surfactant, and a polymer including maleic acid, vinyl acetate and alkyl acrylate monomers. The laundry detergent compositions can optionally include a second polymer including acrylate monomers. Such compositions may reduce encrustation in textiles, particularly when used with hard water.

The alkalinity source provides detersive action to the detergent composition. Suitable alkalinity sources include but are not limited to alkali metal hydroxides, alkali metal carbonates, alkali metal bicarbonates and mixtures thereof. Example alkalinity sources include sodium hydroxide, potassium hydroxide, sodium carbonate (i.e., soda ash), and potassium carbonate.

The detergent composition can include an effective amount of the alkalinity source to enhance cleaning of textiles and improve soil removal performance of the composition. An effective amount of the alkalinity source may provide a use composition (i.e., an aqueous solution containing the detergent composition) having a pH of at least about 10. In another example, an effective amount of the alkalinity source may provide a use composition having a pH between about 10 and about 14.

The alkalinity source may also function as a hydratable salt to form the solid cast. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. There is no requirement that the hydratable component be completely anhydrous.

The detergent composition also includes water of hydration to hydrate the alkalinity source/hydratable salt. It should be understood that the reference to water includes water of hydration and free water. The phrase "water of hydration" refers to water which is somehow attractively bound to a non-water molecule. An exemplary form of attraction includes hydrogen bonding. In addition to hydrating the hydratable salt, the water of hydration also functions to increase the viscosity of the mixture during processing and cooling to prevent separation of the components. The amount of water of hydration in the detergent composition will depend on the alkalinity source/hydratable salt.

The detergent composition also includes at least one nonionic surfactant. Nonionic surfactants useful herein include, but are not limited to, alkoxylated, e.g. ethoxylated, alcohols and alkyl phenols; alkoxylated fatty alcohols of $C_6$ to $C_{22}$ including ethoxylated and mixed ethoxylated-propyloxylated fatty alcohols; polyoxyalkylene and alkyl polyoxyalkylene surfactants; alkylene oxide block copolymers such as ethylene oxide/propylene oxide block copolymers; polyhydroxy fatty acid amides; alkyl polyglycosides; alkylpolysaccharides; glycerol ethers; long chain amine oxides including dimethyldodecylamine oxide, dimethyltetradecylamine oxide, ethylmethyltetradecylamine oxide, cetyldimethylamine oxide, dimethylstearylamine oxide, cetylethylpropylamine oxide, diethyldodecylamine oxide, diethyltetradecylamine oxide, dipropyldodecylamine oxide, bis-(2-hydroxyethyl)dodecylamine oxide, bis(2-hydroxyethyl)-3-dodecoxy-2-hydroxypropylamine oxide, (2-hydroxypropyl) methyltetradecylamine oxide, dimethyloleylamine oxide, dimethyl-(2-hydroxydodecyl)amine oxide, and the corresponding decyl, hexadecyl and octadecyl homologs; long chain phosphine oxides; dialkyl sulfoxides; fatty esters of glycerol; alkoxylated, e.g. ethoxylated, glyceryl esters; condensation products of ethylene oxide with the reaction products of propylene oxide and ethylenediamine; sorbitans and alkoxylated, e.g. ethoxylated, sorbitans; alkoxylated, e.g. ethoxylated phosphate esters; and so forth.

Particularly useful nonionic surfactants include the condensation products of primary and secondary aliphatic alcohols having about 1 to about 25 moles of ethylene oxide. The alkyl chain of the aliphatic alcohol can be either straight or branched, primary or secondary, and generally contains from about 8 to about 22 carbon atoms. The surfactants typically have about 1 to about 20 moles of ethylene oxide (EO), and preferably 3 to 15 moles of EO, and even more preferably about 5 to about 12 moles of EO per mole of alcohol. Condensates with propylene oxides (PO) and butylene oxides (BO) may also be used.

Examples of commercially available nonionic surfactants of this type include, for example the TERGITOL® line of nonionic surfactants including 15-S-9 ($C_{11}$-$C_{15}$ linear alcohol; 9 moles EO) available from Union Carbide Corp. in; the NEODOL® line of nonionic surfactants including 45-9 ($C_{14}$-$C_{15}$ linear alcohol; 9 moles EO) available from Shell Chemical Co. in Houston, Tex.; and $C_{13}$-$C_{15}$ oxo-alcohol ethoxylates available from BASF under the tradename of LUTENSOL® AO.

Nonionic surfactants are discussed in U.S. Pat. No. 3,422,021 incorporated herein by reference in its entirety, and in McCutchins, *Detergents and Emulsifiers,* 1973 Annual and in *Surface Active Agents*, Vol. 2, by Schwartz, Perry and Burch, Interscience Publishers, 1958 and in *Kirk-Othmer Concise Encyclopedia of Chemical Technology,* 1985 at pp. 1143-1144, each of which is incorporated by reference herein.

The detergent composition further includes a polymer containing, consisting of or consisting essentially of maleic acid, alkyl acrylate and vinyl acetate monomers, which may function to improve detergency of the detergent composition when used with hard water. The maleic acid, alkyl acrylate and vinyl acetate polymer may include one or more alkyl acrylate monomers. Suitable alkyl acrylate monomers include methyl acrylate, ethyl acrylate, propyl acrylate, butyl acrylate, isopropyl acrylate and tert-butyl acrylate.

In one example, the polymer is a terpolymer containing maleic acid, alkyl acrylate and vinyl acetate monomers. A suitable maleic acid, alkyl acrylate and vinyl acetate terpolymer has a molecular weight between about 500 g/mol and about 5,000 g/mol. A more suitable maleic acid, alkyl acrylate and vinyl acetate terpolymer has a molecular weight between about 500 g/mol and about 3,000 g/mol. The polymer may comprise between about 30% and about 99% by weight maleic acid, between about 1% and about 60% by weight vinyl acetate and between about 1% and about 60% by weight alkyl acrylate. In a specific example the terpolymer may comprise between about 40% and about 99% by weight maleic acid, between about 1% and about 50% by weight vinyl acetate and between about 1% and about 50% by weight ethyl acrylate.

The maleic acid, alkyl acrylate and vinyl acetate polymer can be biodegradable. A suitable maleic acid, alkyl acrylate and vinyl acetate terpolymer can be at least about 15% biodegradable. A particularly suitable maleic acid, alkyl acrylate and vinyl acetate terpolymer can be between about 15% and 60% biodegradable after 35 days using the test protocol of OECD 302B (adopted 1992). Example commercially available maleic acid, alkyl acrylate and vinyl acetate terpolymers include Belclene® 283 and Belclene® 810 both available from BWA, Tucker, Ga.

The alkyl acrylate and vinyl acetate monomers may hydrolyze in the concentrate or in the use composition. For example, at high pH the alkyl acrylate and/or vinyl acetate segments can hydrolyze to esters. As used herein, reference to an alkyl acrylate and/or vinyl acetate monomer includes all hydrolyzed forms of such monomer. In one example the polymer may include at least one hydrolyzed vinyl acetate or alkyl acrylate monomer. Additionally, as used herein, reference to maleic acid monomers include monomers of maleic acid and salts thereof.

The detergent composition can be phosphorus-free and/or nitrilotriacetic acid (NTA)-free to make the detergent composition more environmentally beneficial. Phosphorus-free means a composition having less than approximately 0.5 wt %, more particularly less than approximately 0.1 wt %, and even more particularly less than approximately 0.01 wt % phosphorous based on the total weight of the composition. NTA-free means a composition having less than approximately 0.5 wt %, less than approximately 0.1 wt %, and particularly less than approximately 0.01 wt % NTA based on the total weight of the composition. When the composition is NTA-free, it is also compatible with chlorine, which functions as an anti-redeposition and stain-removal agent.

The detergent composition can optionally include at least one second polymer containing acrylate monomers. In one example the polymer containing acrylate monomers is an acrylic acid homopolymer. In another example, the polymer containing acrylate monomers includes methacrylate monomers. In a further example, the polymer is a synthetic polymer containing acrylic acid or methacrylate monomers. Suitable commercially available acrylic acid homopolymers include Acusol 944 and Acusol 445N, both available from Dow Chemical. Suitable commercially available methacrylate polymers include Alcosperse 125 available from Akzo Nobel Surfactants, Chicago, Ill. The detergent can also include mixtures of acrylic acid homopolymers and/or polymers including acrylate monomers.

A suitable concentration range of the components in the detergent composition include between approximately 1% and approximately 75% by weight of the alkalinity source, between approximately 0.5% and approximately 50% by weight of at least one nonionic surfactant, and greater than or equal to approximately 0.5% by weight of the polymer containing maleic acid, vinyl acetate and alkyl acrylate monomers. A particularly suitable concentration range of the components in the detergent composition include between approximately 1% and approximately 75% by weight of the alkalinity source, between approximately 5% and approximately 30% by weight of at least one nonionic surfactant, and between approximately 0.5% and approximately 20% by weight of the polymer containing maleic acid, vinyl acetate and alkyl acrylate monomers. In a more particularly suitable concentration range of the components in the detergent composition include between approximately 5% and approximately 65% by weight of the alkalinity source, between approximately 5% and approximately 30% by weight of at least one nonionic surfactant, and between approximately 1% and approximately 15% by weight of the polymer containing maleic acid, vinyl acetate and alkyl acrylate monomers.

When at least one second polymer containing acrylate monomers is present, a suitable concentration range of the components in the detergent composition include between approximately 1% and approximately 75% by weight of the alkalinity source, between approximately 0.5% and approximately 50% by weight of at least one nonionic surfactant, between approximately 0.5% and approximately 30% by weight of the polymer including acrylate monomers, and greater than or equal to approximately 0.5% by weight of the polymer containing maleic acid, vinyl acetate and alkyl acrylate monomers. A particularly suitable concentration range of the components in the detergent composition include between approximately 1% and approximately 75% by weight of the alkalinity source, between approximately 5% and approximately 30% by weight of at least one nonionic surfactant, between approximately 0.5% and approximately 30% by weight of the polymer including acrylate monomers, and between approximately 0.5% and approximately 20% by weight of the polymer containing maleic acid, vinyl acetate and alkyl acrylate monomers. In a more particularly suitable concentration range of the components in the detergent composition include between approximately 5% and approximately 65% by weight of the alkalinity source, between approximately 5% and approximately 30% by weight of at least one nonionic surfactant, between approximately 1% and approximately 25% by weight of the polymer including acrylate monomers, and between approximately 1% and approximately 15% by weight of the polymer containing maleic acid, vinyl acetate and alkyl acrylate monomers.

Additional Functional Materials

The detergent composition can also include various additional functional components. In some embodiments, the alkalinity source, the at least one nonionic surfactant, the maleic acid, alkyl acrylate and vinyl acetate polymer, and optionally at least one polymer including acrylate monomers make up a large amount, or even substantially all of the total weight of the detergent composition. In one specific example, the detergent composition consists essentially of the alkalinity source, the at least one nonionic surfactant, a maleic acid, vinyl acetate and alkyl acrylate terpolymer, and optionally at least one acrylic acid homopolymer. In another example, at least one functional material, which may include the nonionic surfactant, may be present so that the detergent composition consists essentially of the alkalinity source, the maleic acid, vinyl acetate and alkyl acrylate terpolymer, at least one functional material, and optionally at least one acrylic acid homopolymer.

Functional materials are added to provide desired properties and functionalities to the detergent composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. Moreover, the components discussed above may be multi-functional and may also provide several of the functional benefits discussed below.

Co-Surfactants

One or more co-surfactants may be used in combination with the nonionic surfactants. Co-surfactants include anionic, cationic, and zwitterionic and amphoteric surfactants.

Useful zwitterionic or amphoteric surfactants include the betaines and sulfobetaines, i.e. sultaines. Examples of betaines include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropyl ammonium pentanoate, and so forth.

Amphoteric surfactants may be broadly described as derivatives of aliphatic, or alkyl substituted hetero cyclic, secondary and tertiary amines in which the aliphatic radical may be straight chain or branched and wherein one of the aliphatic substituents contains from about 8 to 18 carbon atoms and at least one contains an anionic water-solubilizing group, e.g., carboxy, sulfonate and sulfate, and include, but are not limited to, N-coco-3-aminopropionic acid and acid salts, N-tallow-3-iminodiproprionate salts; N-lauryl-3-iminodiproprionate disodium salt; N-carboxymethyl-N-cocoalkyl-N-dimethylammonium hydroxide; N-carboxymethyl-N-dimethyl-N-(9-octadecenyl)ammonium hydroxide; (1-carboxyheptadecyl)trimethylammonium hydroxide; (1-carboxyundecyl)trimethylammonium hydroxide, N-cocoamidoethyl-N-hydroxyethylglycine sodium salt; N-hydroxyethyl-N-stearamidoglycine sodium salt; N-hydroxyethyl-N-lauramido-β-alanine sodium salt; N-cocoamido-N-hydroxyethyl-β-alanine sodium salt; mixed acyclic amines, and their ethoxylated and sulfated sodium salts; 2-alkyl-1-carboxymethyl-1-hydroxyethyl-2-imidazolinium hydroxide sodium salt or free acid wherein the alkyl group may be nonyl, undecyl, or heptadecyl; 1,1-bis(carboxymethyl)-2-undecyl-2-imidazolinium hydroxide disodium salt and oleic acid-ethylenediamine condensate; propoxylated and sulfated sodium salt; amine oxide amphoteric surfactants; sodium 3-(dodecylamino)propionate, sodium 2-(dodecylamino)ethyl sulfate; sodium 2-(dimethylamino)octadecanoate; disodium 3-(N-carboxymethyldodecylamino)propane-1-sulfonate; disodium octadecyl-iminodiacetate; sodium 1-carboxymethyl-2-undecylimidazole; sodium N,N-bis(2-hydroxyethyl)-2-sulfato-3-dodecoxy-propylamine; and so forth. This list is intended for illustrative purposes only, and is by no means an exclusive list.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent attached to an "onium" atom and containing an anionic water-solubilizing group, e.g., carboxy, sulfonate, sulfate, phosphate, or phosphonate. Examples of zwitterionic surfactants include 3-(N,N-dimethyl-N-hexadecylammonio)-propane-1-sulfonate; 3-(N,N-dimethyl-N-hexadecylammonio)-2-hydroxypropane-1-sulfonate; N,N-dimethyl-N-dodecylammonio acetate; 3-(N,N-dimethyl-N-dodecylammonio)propionate; 2-(N,N-dimethyl-N-octadecylammonio)ethyl sulfate; 3-(P,P-dimethyl-P-dodecylphosphonio)propane-1-sulfonate; 2-(S-methyl-5-tert-hexadecylsulfo)ethane-1-sulfonate; 3-(S-methyl-5-dodecylsulfonio)propionate; N,N-bis(oleylamidopropyl-N-methyl-N-carboxymethylammonium betaine; N,N-bis(stearamidopropyl)-N-methyl-N-carboxymethylammonium betaine; N-(stearamidopropyl)-N-dimethyl-N-carboxymethylammonium betaine; 3-(N-4-n-dodecylbenzyl-N,N-dimethylammonio)propane-1-sulfonate; 3-(N-dodecylphenyl-N,N-dimethylammonio)-propane-1-sulfonate; and so forth.

Amphoteric or zwitterionic surfactants are discussed in commonly assigned U.S. Pat. No. 5,876,514 incorporated by reference herein.

Useful anionic surfactants include, but are not limited to, alkyl benzene sulfonates; primary, branched-chain and random alkyl sulfates; secondary (2,3) alkyl sulfates; unsaturated sulfates such as oleyl sulfate; alpha-sulfonated fatty acid esters; sulfated alkyl polyglycosides; alkyl alkoxy sulfates such as EO 1-7 ethoxy sulfates; alkyl alkoxy carboxylates including EO 1-5 ethoxycarboxylates; amine oxides; alkyl ether sulfates which are the condensation products of ethylene oxide and monohydric alcohols having about 10 to about 20 carbon atoms derived from natural fats, e.g., coconut oil or tallow, or from synthetic means including sodium coconut alkyl triethylene glycol ether sulfate, lithium tallow alkyl triethylene glycol ether sulfate, sodium tallow alkyl hexaoxyethylene sulfate, and so forth; paraffin sulfonates and olefin sulfonates in which the alkyl or alkenyl group contains from about 10 to about 20 carbon atoms; $C_8$-$C_{22}$ soaps; disulfonates, disulfates; and so forth.

Alkali metal fatty acid soaps of a mono- or di-carboxylic acid including those of oleic, ricinoleic acid, alk(en)yl succinate such as dodecyl succinate, and fatty acids derived from castor oil, rapeseed oil, groundnut oil, coconut oil, palmkernel oil or mixtures thereof may also be utilized as cosurfactants. Sodium or potassium are commonly used counterions. These fatty acid soaps typically have anywhere from about 8 to about 24 carbon atoms and preferably about 10 to about 20 carbon atoms.

Any combination of surfactants may be utilized provided that the surfactant mixture have at least one nonionic surfactant. The cosurfactants are useful from about 0.5 to 50 parts by weight. This list is intended only as a guide, and not as an exclusive list. Surfactants are discussed in detail in *McCutcheon's Detergents and Emulsifiers,* 1999, North American Edition, MC Publishing Co.

Builders or Water Conditioners

The detergent composition can include detergency builders or fillers. Detergency builders or fillers are used to treat or soften water and to prevent the formation of precipitates or other salts. A builder is typically a material that enhances or maintains the cleaning efficiency of a detergent composition. Several types of compounds with different performance capabilities are used.

Builders have a number of functions. For instance, they can supply alkalinity to a detergent formulation useful for cleaning acid soils, and can provide buffering to maintain alkalinity at an effective level to aid in keeping removed soil from redepositing during washing into emulsified oil and greasy soils. However, their primary function is the inactivation of water hardness by complexing with hard water cations which form salts insoluble in water, for example calcium and magnesium cations, through the mechanism of sequestration or cation exchange. Detergency builders include the broad classes of phosphorus-containing inorganic salts, organic builders and non-phosphorous-containing builders.

Examples of useful organic builders include, for example, the alkali metal salts of ethylenediaminetetraacetic acid (EDTA), nitrilotriacetates, oxydisuccinates, melitic acid salts, benzene polycarboxylates, tartrate mono succinate, tartrate disuccinate, citrates, polyacetates, carboxylates, polycarboxylates, polyacetyl carboxylates, polyhydroxysulfonates, carbonates, bicarbonates, and so forth. Sodium, potassium, lithium, ammonium, and substituted ammonium salts are commonly employed.

Examples of phosphorous-containing inorganic detergency builders include the water-soluble salts, orthophosphates, polyphosphates including the alkali metal pyrophosphates such as tetrasodium or tetrapotassium pyrophosphates and tripolyphosphates such as sodium and potassium tripolyphosphates, alkali metal metaphosphates, phosphonates, phosphates and hexametaphophates, and so forth.

Phosphorous-free detergency builders include, but are not limited to, alkali metal silicates including cation-exchange amorphous or crystalline aluminosilicates (i.e. zeolites) of natural or synthetic origin.

As noted above, the builders may operate through sequestration of ion complexation mechanisms.

Some specific preferred builders include, but are not limited to, EDTA, diethylenetraminepentaacetic acid, hydroxyethylethylenediaminetetraacetic acid, aminotri(methylenephosphonic acid), 2-phosphonobutane-1,2,4-tricarboxylic acid, diethylenetriaminepenta(methylenephosphonic acid), and so forth.

Sequestrants or chelating agents include those molecules capable of coordinating the metal ions commonly found in water and preventing the metal ions from interfering with the functioning of detersive components within the composition. Examples of those that operate through the mechanism of sequestration include, for example, complex phosphates, phosphonates, amino carboxylic acids, water soluble acrylic polymers, among others.

Examples of phosphonate compositions include phosphonic acids and phosphonic acid salts including the mono, di, tri and tetraphosphonic acids which can also contain groups capable of forming anions under alkaline conditions such as carboxy, hydroxy, thio and the like.

Some examples of amino carboxylic acids include, but are not limited to, N-hydroxyethyliminodiacetic acid, nitrilotriacetic acid (NTA), ethylenediaminetetraacetic acid (EDTA), N-hydroxyethyl-ethylenediaminetriacetic acid (HEDTA), and dimethylenetriaminepentaacetic acid (DTPA).

Examples of water soluble acrylic polymers include, but are not limited to, polyacrylic acid, polymethacrylic acid, acrylic acid-methacrylic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, and so forth, and mixtures thereof. The water soluble salts or partial salts of these polymers including the alkali metal salts of sodium or potassium, and ammonium salts are also suitably employed. In certain embodiments of the present invention, polyacrylic acid polymers, the partial sodium salts of polyacrylic acid or sodium polyacrylate having average molecular weights within the range of 4000 to 8000 are utilized.

An example of a useful ion exchange builder are the silicates such as sodium aluminum silicate.

Other useful fillers include kaolin clays; smectite clays including alkali and alkaline earth metal montmorillonites, saponites and hectorites; bentonite clays; starches; and so forth. Some of these materials also provide fabric softening characteristics such as the smectite clays and the bentonite clays.

Detergent builders are well understood materials and are known to those of skill in the art. Builders are discussed in commonly assigned U.S. Pat. No. 5,876,514 incorporated by reference herein in its entirety.

Other Functional Materials

Other optional functional materials include, but are not limited to, fabric softeners, optical brighteners such as fluorescent whitening agents, enzymes and their stabilizers, perfumes, colorants, antifoaming agents, e.g. silicone compounds, preservatives, and so forth. Such additives are known to those of skill in the art.

Methods of Manufacture

In general, the detergent composition of the present invention can be created by combining the alkalinity source, the nonionic surfactant, the polymer including maleic acid, vinyl acetate and alkyl acrylate monomers, optionally the polymer including acrylate monomers, and any additional functional components and allowing the components to interact.

The alkalinity source, the nonionic surfactant, the polymer including maleic acid, vinyl acetate and alkyl acrylate monomers, the polymer including acrylate monomers, and any additional functional components can harden into solid form. The solidification process may last from a few minutes to about six hours, depending on factors including, but not limited to: the size of the formed or cast composition, the ingredients of the composition, and the temperature of the composition.

The solid detergent compositions may be formed using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

By the term "solid", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and particularly up to approximately 120° F.

The resulting solid detergent composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the composition have a weight of approximately 100 grams or greater, and solid block detergents formed by the composition have a mass of between approximately 1 and approximately 10 kilograms. The solid compositions provide for a stabilized source of functional materials. In some embodiments, the solid composition may be dissolved, for example, in an aqueous or other medium, to create a concentrated and/or use composition. The solution may be directed to a storage reservoir for later use and/or dilution, or may be applied directly to a point of use.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet having a size of between approximately 1 gram and approximately 50 grams.

In other embodiments, the solid detergent composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

Although the detergent composition is discussed as being formed into a solid product, the detergent composition may also be provided in the form of a paste or liquid. When the concentrate is provided in the form of a paste, enough water is added to the detergent composition such that complete solidification of the detergent composition is precluded. In addition, dispersants and other components may be incorporated into the detergent composition in order to maintain a desired distribution of components.

Methods of Use

The detergent compositions can include concentrate compositions or can be diluted to form use compositions. In general, a concentrate refers to a composition that is intended to be diluted with water to provide a use composition that contacts an object to provide the desired cleaning, rinsing, or the like. The detergent composition that contacts the articles to be washed can be referred to as the use composition. The use composition can include additional functional ingredients at a level suitable for cleaning, rinsing, or the like. In one example, the use composition is contacted with textiles to remove soil from the textiles.

A use composition may be prepared from the concentrate by diluting the concentrate with water at a dilution ratio that provides a use composition having desired detersive properties. The water that is used to dilute the concentrate to form the use composition can be referred to as water of dilution or a dilutent, and can vary from one location to another. The typical dilution factor is between approximately 1 and approximately 10,000 but will depend on factors including water hardness, the amount of soil to be removed and the like. In one embodiment, the concentrate is diluted at a ratio of between about 1:10 and about 1:1000 concentrate to water. Particularly, the concentrate is diluted at a ratio of between about 1:100 and about 1:5000 concentrate to water. More particularly, the concentrate is diluted at a ratio of between about 1:250 and 1:2000 concentrate to water.

A suitable concentration range of the components in the use composition includes between about 20 and 1,500 parts-per-million (ppm) alkalinity source, and between about 20 and 1,000 ppm of the polymer containing maleic acid, vinyl acetate and alkyl acrylate monomers. A particularly suitable concentration range of components in the use composition includes between about 100 and 1,000 ppm alkalinity source, and between about 20 and 500 ppm of the polymer containing the maleic acid, vinyl acetate and alkyl acrylate monomers. A more particularly suitable concentration range of components in the use composition includes between about 250 and 700 ppm alkalinity source, and between about 20 and 500 ppm of the polymer containing the maleic acid, vinyl acetate and alkyl acrylate monomers. When a polymer containing acrylate monomers is present, a suitable concentration range of the polymer containing acrylate monomers is between about 10 and 100 ppm.

The use composition can have an elevated temperature. In one example, a use composition having a temperature between approximately 140° F. and approximately 185° F. is contacted with the textiles to be cleaned. In another example, a use composition having a temperature between approximately 150° F. and approximately 160° F. is contacted with the textiles to be cleaned. In a still further example, the textiles to be cleaned are contacted with a use composition have a temperature between approximately 104° F. and approximately 110° F. The lower temperature of the use composition requires less energy to heat than higher temperature use compositions and conserves energy resources.

The use composition contains an effective concentration of the alkalinity source so that the use composition has a pH of at least about 10, and preferably between about 10 and about 14.

It is recognized that the level of water hardness changes from one locale to another. Accordingly, the concentrate may be diluted with water having varying amounts of hardness depending on the locale or site of dilution. In general, water hardness refers to the presence of calcium, magnesium, iron, manganese, and other polyvalent metal cations that may be present in the water, and it is understood that the level of water hardness varies from municipality to municipality. Water hardness can be characterized by the unit "grain" where one grain water hardness is equivalent to 17.1 ppm hardness expressed as $CaCO_3$, and hard water is characterized as having at least 10 grains of hardness. For example, water is commonly available having at least 5 grains hardness, at least 10 grains hardness, and at least 20 grains hardness. The polymer containing the maleic acid, vinyl acetate and alkyl acrylate monomers of the use solution may function to increase the detergency of the use solution when used with hard water. This enables the laundry detergent composition to be used with water at various locals without needing to soften the water or remove the hardness from the water.

Additionally, it is recognized that the detergent composition may be supplied as a composition including an alkaline source, at least one non-ionic surfactant, and a polymer comprising maleic acid, vinyl acetate and alkyl acrylate monomers. Alternatively, the detergent composition may be formed at the point of use by mixing a builder comprising an alkaline source and a polymer comprising maleic acid, vinyl acetate and alkyl acrylate monomers with a surfactant.

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight bases, and all reagents used in the examples were obtained, or are available, from the chemical suppliers described below, or may be synthesized by conventional techniques.

Materials Used

Solid Surge Plus (SSP): a solid institutional laundry detergent comprising high levels of sodium hydroxide and water conditioning package and available from Ecolab Inc, St. Paul, Minn.

Belclene® 810: a maleic acid, ethyl acrylate and vinyl acetate terpolymer available from BWA Water Additives, Tucker, Ga.

Acusol 944: an acrylic acid homopolymer available from Dow Chemical

Acusol 445N: a fully neutralized homopolymer of acrylic acid available from Dow Chemical Alcosperse 125: a methacrylate polymer available from Akzo Nobel Surfactants, Chicago, Ill.

Twenty Cycle Encrustation Test

Encrustation tests were performed to measure the level of mineral deposits on linen after extended washing. There are two main components to the test: the treatment of the linen during the extended wash cycles and the ashing procedure to measure the level of encrustation.

Washing Procedure

A commercial 35-pound, front-loading washing machine (Huebsch model HX35PVXU60001) was charged with 28 pounds of cotton towels (including test pieces) as ballast. The wash water temperature was 40° C., and the water contained 17 grains of hardness or the equivalent of 1100 mg of calcium carbonate per 3.79 litters. The detergent was dose was 52.5 grams per load. The ballast cotton towels and cotton test pieces were thoroughly washed and dried prior to use to remove any residual finishes from manufacturing.

For each condition to be studied, six new 100% cotton terry towels were used as test pieces. Three circles were cut from each of the six towels. The circles together summed to about 10 g, weighted to +/−0.01 g. The circles were set aside as a starting control. The six towels were washed 20 times (20 wash cycles), with the towels being dried between each cycle. At the end of the 20 cycles, three circles were cut of out of each towel and weighed.

Ashing Procedure

The set of three circles cut from the 20 cycle washed towels was added to a tared 100 mL beaker. The beaker was heated overnight in an oven at 600° F. Each beaker was re-weighed after cooling to establish a final weight. The final total weight minus the initial beaker weight is equal to the mass of the inorganic residue or ash. Dividing the weight of the ash amount by the weight of the initial towels (e.g., 10 grams) yields the ash percent value for one towel. The reported value is the average of the six towels for each condition.

Examples 1 and 2

Solid Surge Plus (SSP) is a solid institutional laundry detergent comprising high levels of alkalinity, 0.5-50% nonionic surfactant, and water conditioners, including 5 wt % Acusol 944 and 12.82 wt % Acusol 445N. Example 1 was a detergent identical to SSP except that in Example 1 the Acusol 445N was replaced with 7 wt % Belclene 810. Example 2 was a detergent identical to SSP except that in Example 2 the Acusol 445N was replaced with 4 wt % Belclene 810. The water conditioners of Examples 1 and 2 and SSP are listed in Table 1. All other components of Examples 1 and 2 were the same as SSP.

TABLE 1

| | Water Conditioners | | |
|---|---|---|---|
| | Acusol 944 | Acusol 445N | Belclene 810 |
| Solid Surge Plus (SSP) | 5% | 12.8% | 0% |
| Example 1 | 5% | 0% | 7% |
| Example 2 | 5% | 0% | 4% |

Twenty cycle encrustation tests were run using the SSP, Example 1 and Example 2 detergents. The test samples were ashed as described. The ash percent values of Table 2 are the average ash values of the six test towels. Also shown is the P value for the T test comparing each Example mean with the mean value for the control Solid Surge Plus.

TABLE 2

| Sample | Ash (%) | P Value |
|---|---|---|
| Solid Surge Plus | 1.994 | |
| Example 1 | 1.565 | 0.016 |
| Example 2 | 1.573 | 0.025 |

The values of Table 2 clearly show that the use of Belclene 810 polymer in place of acrylic acid homopolymer results in statistically significant reductions in linen encrustation. Additionally Table 2 shows that the addition of a polymer including maleic acid, vinyl acetate and alkyl acrylate to a laundry detergent formulation along with a synthetic polymer including acrylic acid is highly effective in preventing calcium carbonate buildup or encrustation in textiles.

Examples 3 and 4

A second encrustation test was performed comparing SSP with Examples 3 and 4. Example 3 was a detergent identical to Solid Surge Plus except that in Example 3 the Acusol 445N was replaced with 5 wt % Belclene 810. Example 4 was a detergent identical to SSP except that in Example 4 the Acusol 445N was replaced with 3.6 wt % Belclene 810, and the Acusol 944 level was increased to 6%. The water conditioners of Examples 3 and 4, and SSP are listed in Table 3. All other components of Examples 3 and 4 were the same as SSP.

TABLE 3

| | Water Conditioners | | |
|---|---|---|---|
| | Acusol 944 | Acusol 445N | Belclene 810 |
| Solid Surge Plus | 5% | 12.8% | 0% |
| Example 3 | 5% | 0% | 5% |
| Example 4 | 6% | 0% | 3.6% |

Twenty cycle encrustation tests were run using the SSP, Example 3 and Example 4 detergents. The test towels were ashed as described above to give the average encrustation or ash values shown in Table 4. These values are the average of the six test towels. Table 4 also shows the P value for the T test comparing each Example mean with the mean value for the control Solid Surge Plus.

TABLE 4

| Sample | Ash (%) | P Value |
|---|---|---|
| Solid Surge Plus | 2.187 | |
| Example 3 | 1.953 | 0.014 |
| Example 4 | 1.980 | 0.188 |

The values for Example 3 in Table 4 clearly show that the use of Belclene 810 polymer in place of acrylic acid homopolymer results in a statistically significant reduction in linen encrustation. In the case of Example 4 the reduced level of Belclene 810 and increased level of Acusol 944 was not sufficient to provide an encrustation level that was statistically different from the SSP control, but the Belclene 810 was still effective enough that just 3.6% of the Belclene polymer was as effective as 12.8% of Acusol 445N polymer at controlling encrustation.

Additionally, Samples 3 and 4 illustrate that the addition of a polymer including maleic acid, vinyl acetate and alkyl acrylate to a laundry detergent formulation along with a synthetic polymer comprising acrylic acid is highly effective at preventing calcium carbonate buildup or encrustation in textiles.

Laundry Encrustation Test II

Thirty 2 inch by 3 inch terry cloth swatches were washed, each with 50 mL of a solution containing 0.025M HCl and 0.025M H2504, prepared with distilled water. The cotton terrycloth swatches were then rinsed thoroughly with distilled water and allowed to dry overnight.

A tergometer was then used to determine encrustation. Each well of the tergotometer was filled with 1 liter of 17 grain water and allowed to heat to 140° F. Four terry cloth swatches were added to each well followed by 10 g of 10% solution of detergent. Each detergent was run in duplicate. The wash time was 10 minutes. When the cycle was complete, each swatch was rinsed with 17 grain water. After the completion of 5 cycles, one terry cloth swatch was removed from each well. After an additional 5 cycles was complete, another terry cloth swatch was removed from each well. This was repeated for a total of 20 cycles.

The terry cloth swatches were dried overnight. The calcium carbonate buildup on the test fabric was measured by eluting with 75 mL of a solution containing 0.1M HCl and 0.1M H2SO4 in a 125 mL Erlenmeyer flask. The values for calcium were determined by ICP expressed as ppm of calcium carbonate.

Examples 5-8 and Control 1

The raw materials identified for Control 1 and Examples 5-8 in Table 5 below were combined and mixed to form concentrate cleaning compositions.

TABLE 5

| | Control 1 | Example 5 | Example 6 | Example 7 | Example 8 |
|---|---|---|---|---|---|
| Softened Water | 37.11 | 36.67 | 34 | 35.33 | 38 |
| Sodium Hydroxide | 54 | 54 | 54 | 54 | 54 |
| Belclene 810, 50% (terpolymer) | 0 | 6 | 2 | 4 | 8 |
| Alcosperse 125, 30% (synthetic polymer) | 0 | 3.33 | 10 | 6.67 | 0 |
| Acusol 445N, 45% (synthetic polymer) | 8.89 | 0 | 0 | 0 | 0 |

For Control 1, a positive formulation was tested with the addition of Acusol 445N, as a synthetic polymer source to a laundry cleaning composition formulation. Examples 5-7 included varying amounts of the addition of Belclene 810, a biodegradable terpolymer source, and Alcosperse 125, a synthetic polymer source, to a laundry cleaning composition formulation. Example 8 included only the addition of Belclene 810 to the laundry cleaning composition formulation. The purpose of these tests were to determine if the addition of a biodegradable polymer alone or in conjunction with a synthetic polymer to a laundry cleaning composition formulation is effective in preventing calcium carbonate encrustation on textiles.

A laundry encrustation test was performed with Control 1 and Examples 5-8 as described in the laundry encrustation method described above, and the results are listed below in Tables 6-10.

TABLE 6

| Formulation | ppm Calcium Hardness | No. of Cycles |
|---|---|---|
| Control 1 | 0.415 | 0 |
| Example 5 | 0.39 | 0 |
| Example 6 | 0.41 | 0 |
| Example 7 | 0.43 | 0 |
| Example 8 | 0.38 | 0 |

TABLE 7

| Formulation | ppm Calcium Hardness | No. of Cycles |
|---|---|---|
| Control 1 | 138 | 5 |
| Example 5 | 31.85 | 5 |
| Example 6 | 48.05 | 5 |
| Example 7 | 43.05 | 5 |
| Example 8 | 36.6 | 5 |

TABLE 8

| Formulation | ppm Calcium Hardness | No. of Cycles |
|---|---|---|
| Control 1 | 543 | 10 |
| Example 5 | 50.4 | 10 |
| Example 6 | 133.5 | 10 |
| Example 7 | 77.05 | 10 |
| Example 8 | 45.55 | 10 |

TABLE 9

| Formulation | ppm Calcium Hardness | No. of Cycles |
|---|---|---|
| Control 1 | 1135 | 15 |
| Example 5 | 51.65 | 15 |
| Example 6 | 210 | 15 |
| Example 7 | 159.05 | 15 |
| Example 8 | 30.95 | 15 |

TABLE 10

| Formulation | ppm Calcium Hardness | No. of Cycles |
|---|---|---|
| Control 1 | 2645 | 20 |
| Example 5 | 66.9 | 20 |
| Example 6 | 369.5 | 20 |
| Example 7 | 288 | 20 |
| Example 8 | 54.4 | 20 |

As can be seen in Table 6, all of the terry cloth swatches originally started with very low calcium carbonate encrustation. However, as the number of wash cycles increased the calcium carbonate encrustation for Control 1 formulation was quite high, whereas, the calcium hardness for Examples 5-8 remained relatively low, even after 20 cycles, as illustrated in Table 10. From these results, it can be determined that the addition of a polymer including maleic acid, vinyl acetate and alkyl acrylate to a laundry cleaning composition formulation with or without an additional synthetic polymer source is highly effective in preventing calcium carbonate buildup on textiles.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A method of cleaning textiles, the method comprising:

forming a use composition by mixing water with a laundry detergent composition, the laundry detergent composition comprising at least one alkalinity source consisting of alkali metal hydroxides, at least one nonionic surfactant, and a polymer including maleic acid, vinyl acetate and alkyl acrylate monomers; and contacting textiles with the use composition, wherein the use composition has a concentration of the polymer including maleic acid, vinyl acetate and alkyl acrylate monomers of approximately 20 to approximately 1,000 parts per million (ppm), a pH between about 10 and 14, and a temperature between about 104 and about 110 degrees Fahrenheit.

2. The method of claim 1, wherein the polymer comprises:

the monomer of maleic acid in an amount of between approximately 30% and approximately 99% by weight of the polymer;

the vinyl acetate monomer in an amount of between approximately 1% and approximately 60% by weight of the polymer; and the alkyl acrylate monomer in an amount of between approximately 1% and approximately 60% by weight of the polymer.

3. The method of claim 1, wherein the water has a hardness greater than about 5 grains hardness.

4. The method of claim 1, wherein the polymer including maleic acid, vinyl acetate and alkyl acrylate monomers is a terpolymer.

5. The method of claim 1, wherein the alkyl acrylate monomer is selected from the group consisting of methyl acrylate, ethyl acrylate, propyl acrylate, butyl acrylate, isopropyl acrylate and tert-butyl acrylate.

6. The method of claim 1, wherein the laundry detergent composition further comprises at least one second polymer comprising acrylate monomers.

7. The method of claim 6, wherein the at least one second polymer comprising acrylate monomers includes an acrylic acid homopolymer and wherein the use composition has an acrylic acid homopolymer concentration of between approximately 10 ppm and about 100 ppm.

8. The method of claim 1, wherein the laundry detergent consists essentially of the alkalinity source, the polymer, at least one second polymer comprising acrylate monomers, and at least one functional ingredient.

9. The method of claim 1, wherein the alkalinity source is sodium hydroxide.

* * * * *